US006929952B2

(12) United States Patent
Baerlocher

(10) Patent No.: US 6,929,952 B2
(45) **Date of Patent: *Aug. 16, 2005**

(54) GAMING DEVICE HAVING A BONUS SCHEME WITH SYMBOL GENERATOR AND SYMBOL TERMINATING CONDITION

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 66 days.

This patent is subject to a terminal disclaimer.

(21) Appl. No.: 10/608,867

(22) Filed: Jun. 27, 2003

(65) Prior Publication Data

US 2004/0002370 A1 Jan. 1, 2004

Related U.S. Application Data

(63) Continuation of application No. 09/652,312, filed on Aug. 31, 2000, now Pat. No. 6,632,139.

(51) Int. Cl.[7] ..... A63F 9/24
(52) U.S. Cl. ..... 436/16
(58) Field of Search ..... 463/16–22, 25–28; 273/143 R, 138.1

(56) References Cited

U.S. PATENT DOCUMENTS

| | | | |
|---|---|---|---|
| 4,695,053 | A | 9/1987 | Vazquez, Jr. et al. |
| 5,205,555 | A | 4/1993 | Hamano |
| 5,324,041 | A | 6/1994 | Boylan et al. |
| 5,342,047 | A | 8/1994 | Heidel et al. |
| 5,449,173 | A | 9/1995 | Thomas et al. |
| 5,536,016 | A | 7/1996 | Thompson |
| 5,766,074 | A | 6/1998 | Cannon et al. |
| 5,769,716 | A | 6/1998 | Saffari et al. |
| 5,788,573 | A | 8/1998 | Baerlocher et al. |
| 5,833,536 | A | 11/1998 | Davids et al. |

(Continued)

FOREIGN PATENT DOCUMENTS

| | | | |
|---|---|---|---|
| EP | | 0874337 A1 | 10/1998 |
| EP | | 0945837 A2 | 9/1999 |
| EP | | 0984408 A2 | 3/2000 |
| WO | PCT/AU97/00121 | | 9/1997 |

OTHER PUBLICATIONS

Top Dollar Brochure written by IGT, published in 1998.
Slot Line Advertisement including Temperature Rising game description written by IGT, published in 1998.
Bonus Spin Red, White & Blue Advertisement written by IGT, available prior to Aug. 2000.
Bingo Brochure written by Casino Data Systems, published in 1998.
Full House Brochure written by Anchor Games, published in 2000.
Jewel in the Crown Advertisement written by IGT, published in 2000.
Red Hot 7's Game Description written by IGT, game available prior to Aug. 2000.
Jackpot Party Brochures, WMS Gaming, Inc., 1998.
Bonus Spin Description and Screen Shots, IGT, available prior to Aug. 2000.
Jester Brochure, IGT, 1999.
Double Buck Brochure, IGT, available prior to Aug. 2000.

*Primary Examiner*—Michael O'Neill
(74) *Attorney, Agent, or Firm*—Bell, Boyd & Lloyd LLC

(57) ABSTRACT

A gaming device with a bonus scheme which includes a symbol generator and a plurality of symbols. When two or more predetermined symbols are generated and displayed, the bonus round terminates. Depending upon which symbols the gaming device generates and displays, the bonus round may or may not terminate. This type of bonus scheme provides an exciting manner of terminating bonus rounds and increases player entertainment.

76 Claims, 12 Drawing Sheets

U.S. PATENT DOCUMENTS 5,851,148 A 12/1998 Brune et al.
5,873,781 A 2/1999 Keane
5,947,820 A 9/1999 Morro et al.
5,964,463 A 10/1999 Moore, Jr.
5,980,384 A 11/1999 Barrie
5,984,781 A 11/1999 Sunaga
5,997,400 A 12/1999 Seelig et al.
6,004,207 A 12/1999 Wilson, Jr. et al.
6,015,346 A 1/2000 Bennett
6,033,307 A 3/2000 Vancura
6,056,642 A 5/2000 Bennett
6,059,289 A 5/2000 Vancura
6,067,438 A 5/2000 Chen et al.
6,089,976 A 7/2000 Schneider et al.
6,102,798 A 8/2000 Bennett
6,120,031 A 9/2000 Adams
6,126,542 A 10/2000 Fier
6,126,547 A 10/2000 Ishimoto
6,135,885 A 10/2000 Lermusiaux
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,164,652 A 12/2000 Lauretta et al.
6,168,520 B1 1/2001 Baerlocher et al.
6,168,523 B1 1/2001 Piechowiak et al.
6,173,955 B1 1/2001 Perrie et al.
6,174,235 B1 1/2001 Walker et al.
6,190,255 B1 2/2001 Thomas et al.
6,203,429 B1 3/2001 Demar et al.
6,231,445 B1 5/2001 Acres
6,261,177 B1 7/2001 Bennett
6,270,409 B1 8/2001 Shuster
6,299,165 B1 10/2001 Nagano
6,309,300 B1 10/2001 Glavich
6,312,334 B1 11/2001 Yoseloff
6,315,660 B1 11/2001 DeMar et al.
6,315,664 B1 11/2001 Baerlocher et al.
6,328,649 B1 12/2001 Randall et al.
6,346,043 B1 2/2002 Colin et al.
6,398,218 B1 6/2002 Vancura
6,413,160 B1 7/2002 Vancura
6,435,511 B1 8/2002 Vancura et al.
2002/0142822 A1 10/2002 Baerlocher et al.
2002/0142823 A1 10/2002 DeMar et al.
2002/0151341 A1 10/2002 Baerlocher et al.
2002/0151357 A1 10/2002 Acres
2002/0155873 A1 10/2002 Berman et al.
2002/0155883 A1 10/2002 Baerlocher
2002/0165019 A1 11/2002 Slomiany

GAMING DEVICE HAVING A BONUS SCHEME WITH SYMBOL GENERATOR AND SYMBOL TERMINATING CONDITION

PRIORITY CLAIM

This application is a continuation of and claims the benefit of U.S. patent application Ser. No. 09/652,312 filed Aug. 31, 2000, issued as U.S. Pat. No. 6,632,139.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which has a bonus scheme including one or more symbol generators and one or more symbol terminating conditions.

BACKGROUND OF THE INVENTION

Many existing gaming machines, such as traditional slot machines, include bonus rounds. Typically, a bonus round begins when the player reaches a bonus triggering event in the primary game of the gaming device. In slot machines with reels, the triggering event usually occurs when the player reaches a predetermined combination of symbols on the reels. Usually the bonus scheme provides the player with an opportunity to gain bonus value before the bonus round terminates.

In existing bonus schemes with symbol generators such as reels and wheels, the bonus round terminates after the player has had a predetermined number of opportunities to gain bonus value or after the player has accumulated a predetermined amount of bonus values. These bonus rounds do not terminate when the player reaches a predetermined combination of symbols.

To increase player enjoyment and excitement, it is desirable to provide players with new bonus schemes for gaming devices which include symbol generators and symbol terminating conditions.

SUMMARY OF THE INVENTION

The present invention overcomes the above shortcomings by providing a gaming device and method which has a bonus scheme which includes one or more symbol generators, a plurality of symbols and one or more terminating conditions. The symbol generator is a device, method or system which generates certain symbols as an outcome for a player. Preferably, the symbol generator is a computer program or mathematical formula, and the computer of the gaming device inputs certain symbols into the generator which then generates certain symbols as output. The term symbol, as used herein, includes any representation in audio, visual or audio-visual form whether in motion or at rest such as letters, numerals, characters and pictures, drawings or other representations of people, places or things.

The gaming device can graphically represent the symbol generator as any mechanism or any other system or device. For example, a symbol generator can be represented as a plurality of reels (in physical or video form) in a gaming device, a spinning wheel (in physical or video form) or a set of dice. The reels, spinning wheel and dice would include a plurality of symbols, such as a mixture of characters and numeric values.

The bonus scheme of the present invention also includes one or more terminating conditions which terminate the bonus round after the player has had an opportunity to gain at least one bonus value. The terminating condition occurs when the symbol generator generates two or more predetermined symbols. For example, a terminating condition could be a combination of letters, such as X, Y and Z, generated by the gaming device. Preferably, the terminating condition occurs at one or more predetermined result areas. The result area is a certain area where symbols must be located in order for a terminating condition to occur.

In the context of reels, the result area is two or more symbol areas, preferably defined by one or more lines extending from outer reel to outer reel. In the context of a spinning wheel, the result area is preferably two or more areas, preferably identified by result pointers.

In operation, the bonus round is initiated when a triggering event occurs. Once the bonus round is initiated, the gaming device (preferably randomly) generates a plurality of symbols, preferably by enabling the player to push a play button or other activator device. Depending upon which symbols are generated and the design of the bonus scheme, the player may gain a bonus value, gain no bonus value or the bonus round may terminate. If a terminating condition does not occur, the gaming device provides the player with any earned bonus value and then generates a second set of symbols by enabling the player to push the play button again. This process continues until a terminating condition occurs.

In a preferred embodiment of the present invention, the symbol generator is a plurality of reels which display a plurality of symbols. In another preferred embodiment, the symbol generator is one or more spinning wheels. In either case, the symbol generator has the capacity to generate numeric and non-numeric symbols (i.e., the numeral five and a character). The terminating condition occurs when the symbol generator generates at least two non-numeric symbols in a specified result area. As long as the player avoids this terminating condition, the gaming device awards the player with bonus value equal to the sum of all numeric symbols displayed in the result area.

The present invention provides a gaming device with a bonus scheme which involves symbol generators and terminating conditions. Whether the generator is a plurality of reels or a spinning wheel, the player may continue to spin the reels or the spinning wheel with the aim of gaining bonus values, until the player reaches a terminating condition. The terminating condition occurs when the symbol generator generates two or more predetermined symbols which cause the bonus round to terminate.

It is therefore an object of the present invention to provide a gaming device with a bonus scheme which includes one or more symbol generators and one or more symbol terminating conditions.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
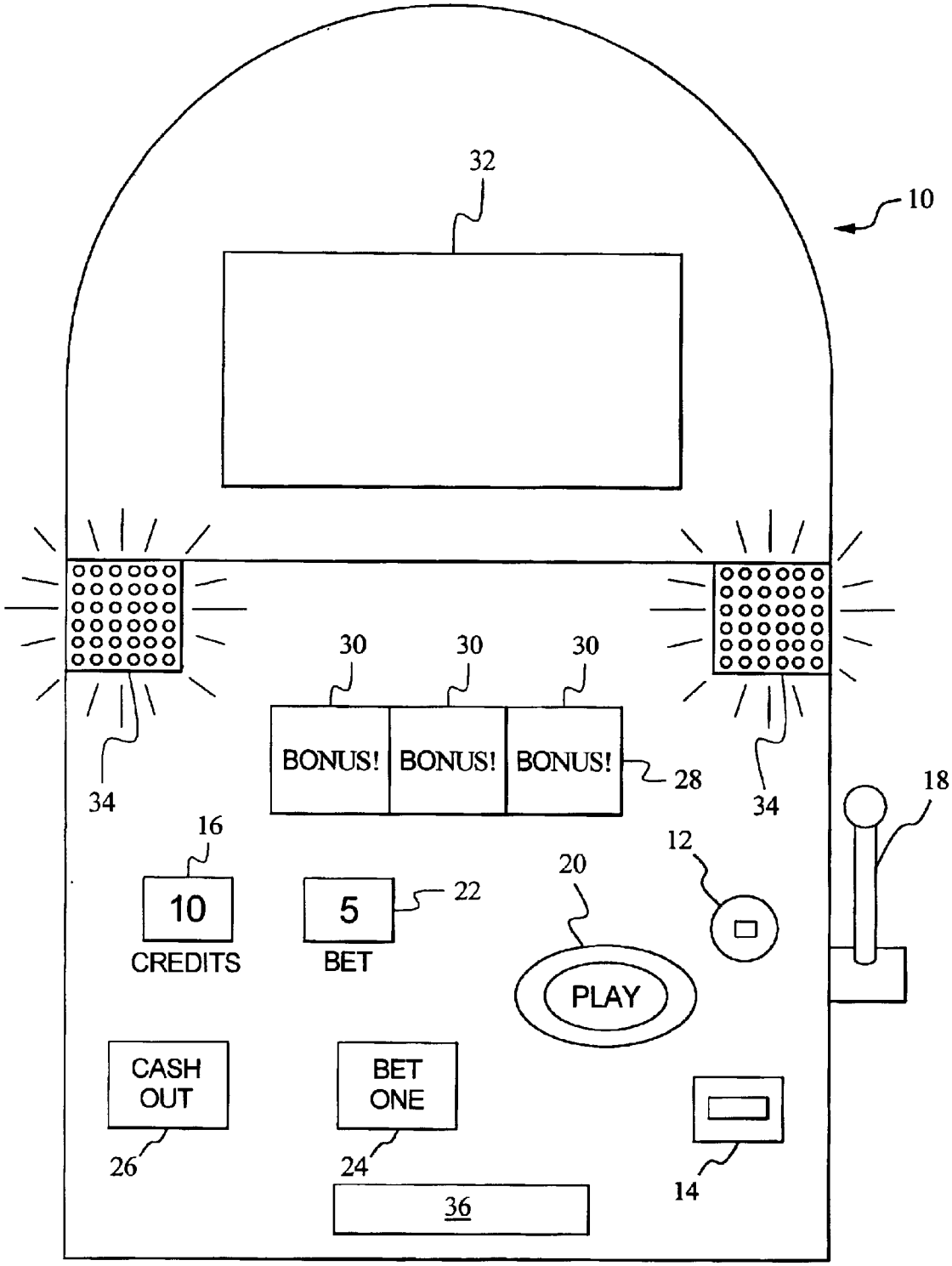
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
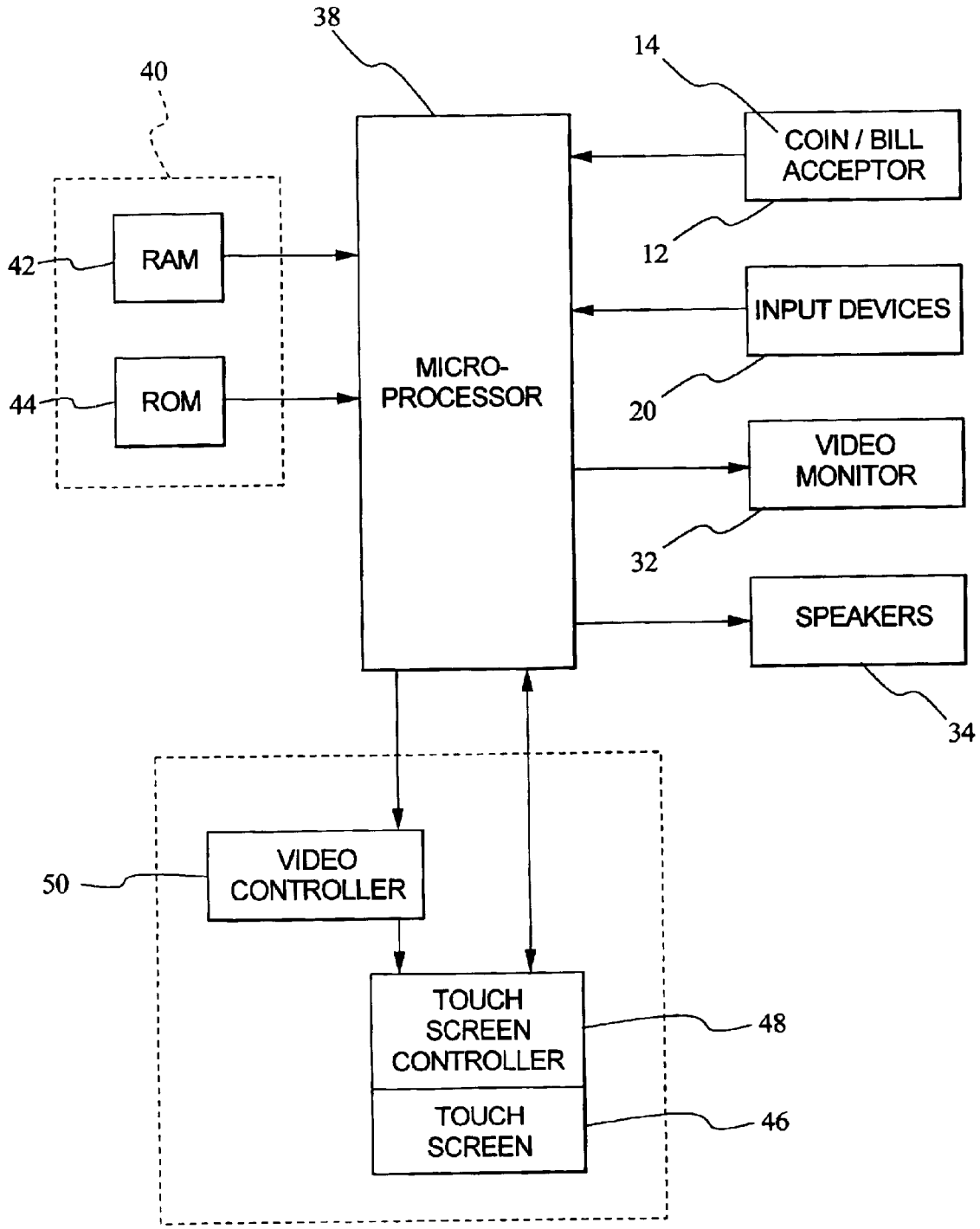
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a video monitor 32 or other display device (i.e., a liquid crystal display) and at least one input device such as play buttons 20. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses play buttons 20 to input signals into gaming device 10. Furthermore, it is preferable that touch screen 46 and an associated touch screen controller 48 are used instead of a conventional video monitor 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer."

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on the display window 28. The gaming device 10 also includes a display device such as a video monitor 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Scheme

If a player achieves a bonus triggering or qualifying condition while playing the game, the gaming device 10 automatically initiates the bonus round of the present invention. The bonus scheme of the gaming device of the present invention includes one or more symbol generators, a plurality of symbols and one or more terminating conditions.

Figure 3:
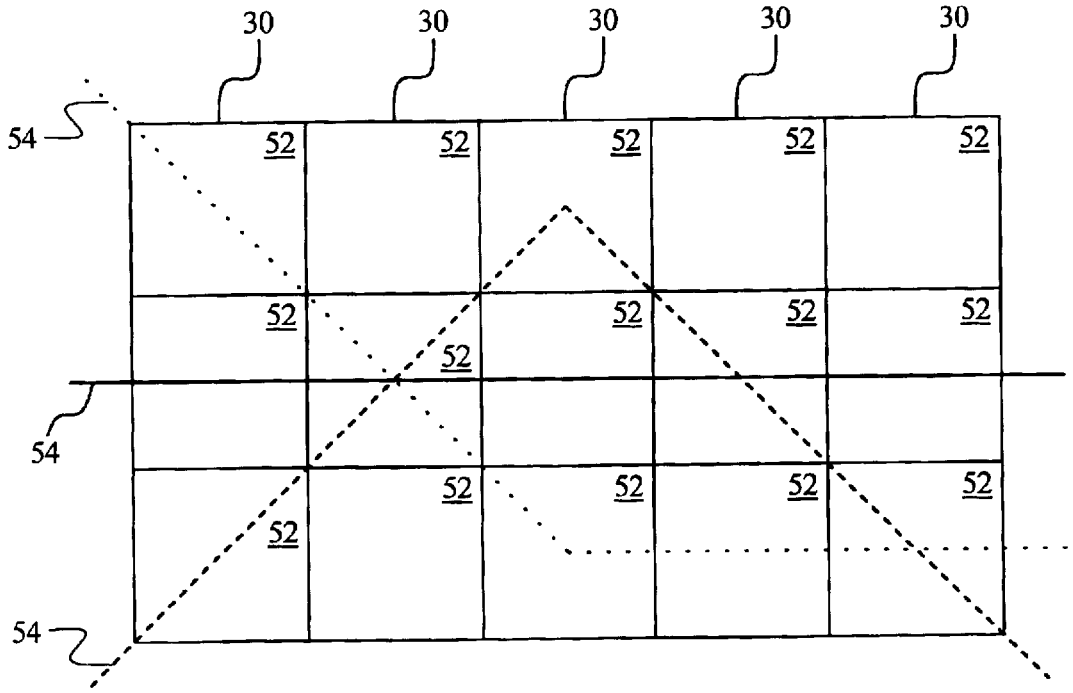
FIG. 3 is a top plan view of the reels, symbol areas and result lines in one embodiment of the present invention.
Figure 4:
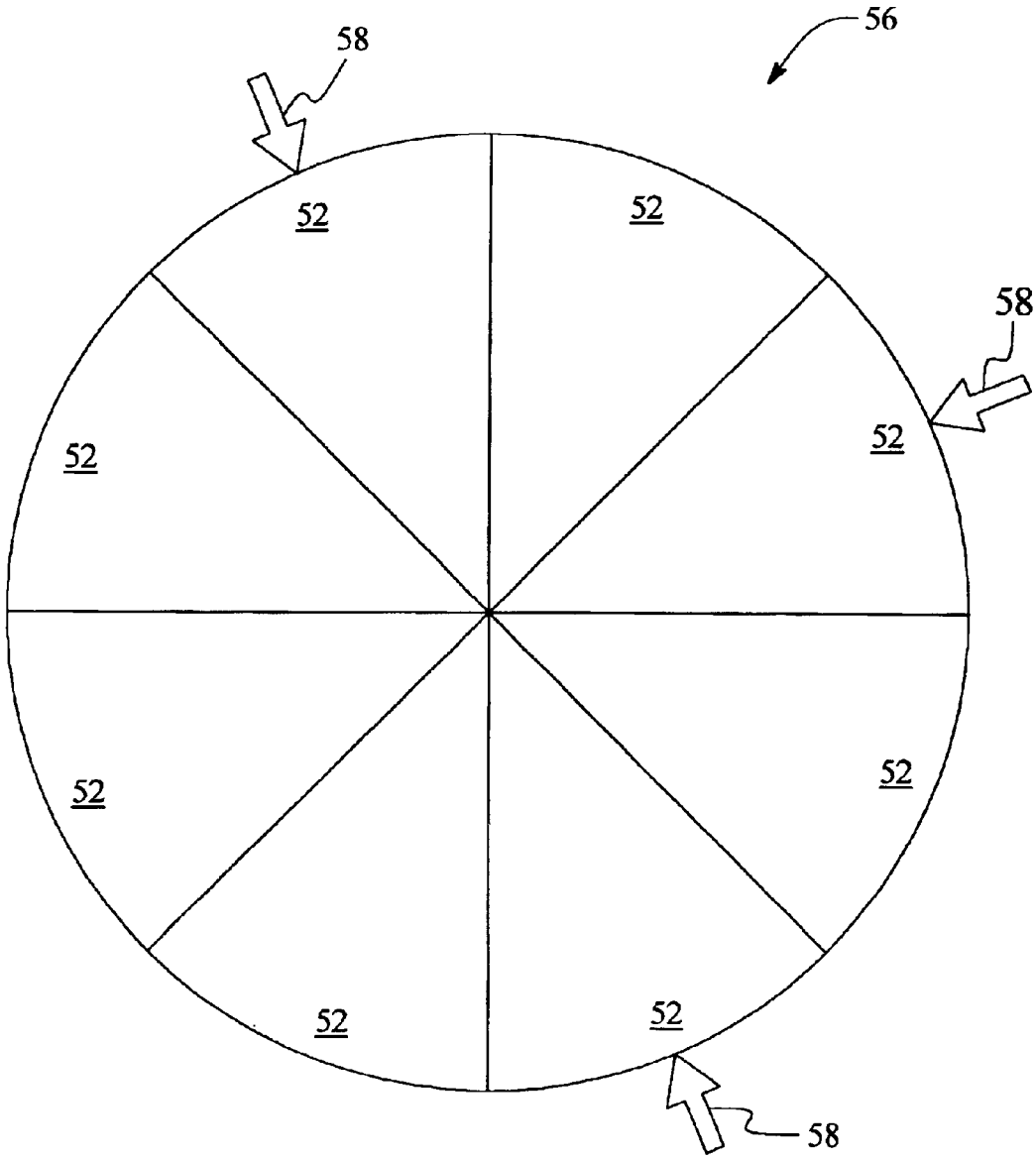
FIG. 4 is a top plan view of the spinning wheel, symbol areas and result pointers in one embodiment of the present invention.

In one preferred embodiment shown in FIG. 3, the symbol generator is a plurality of reels 30 displayed by the gaming device. Reels 30 include a plurality of symbol areas 52 and one or more result areas. The result areas here are the symbol areas 52 which are intersected by one or more result lines 54, as shown in FIG. 3. In another embodiment, the symbol generator is a spinning wheel 56 which includes a plurality of symbol areas 52, as shown in FIG. 4. This symbol generator also includes one or more result areas which are defined and identified by result pointers 58 shown in FIG. 4. In both of these embodiments, the result areas are preferably the only symbol areas 52 where a terminating condition can occur.

Figure 5:
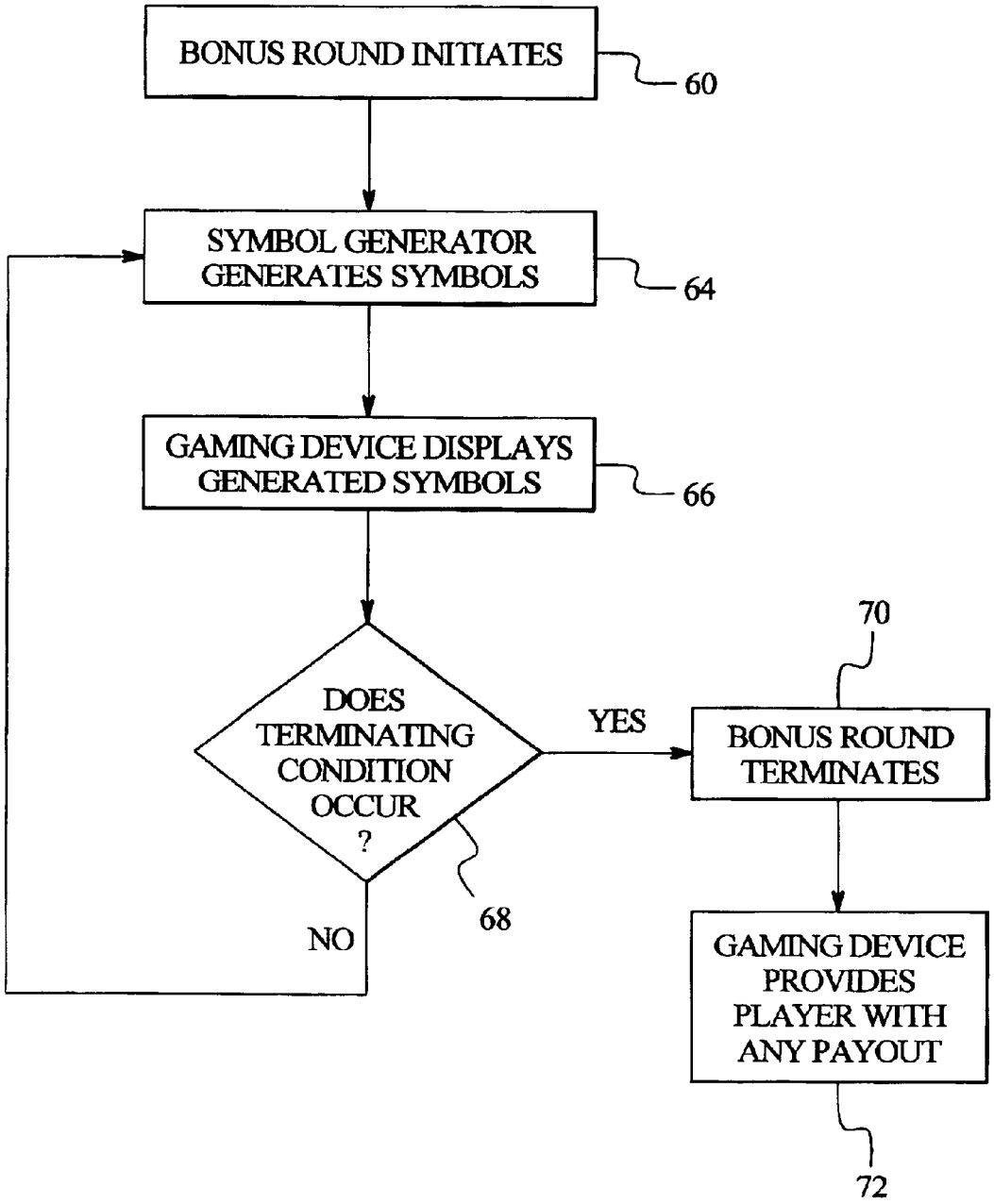
FIG. 5 is a flow diagram of one embodiment of the present invention.
Figure 6:
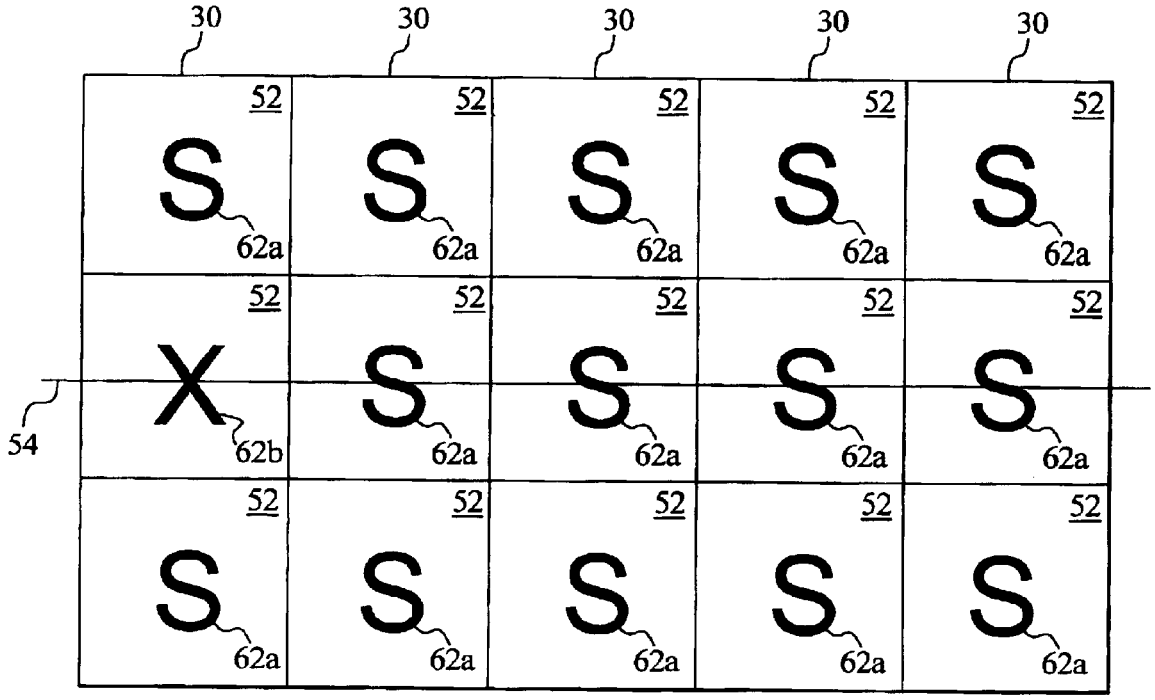
FIG. 6 is a top plan view of the reels, symbols and non-terminating condition in one embodiment of the present invention.
Figure 7:
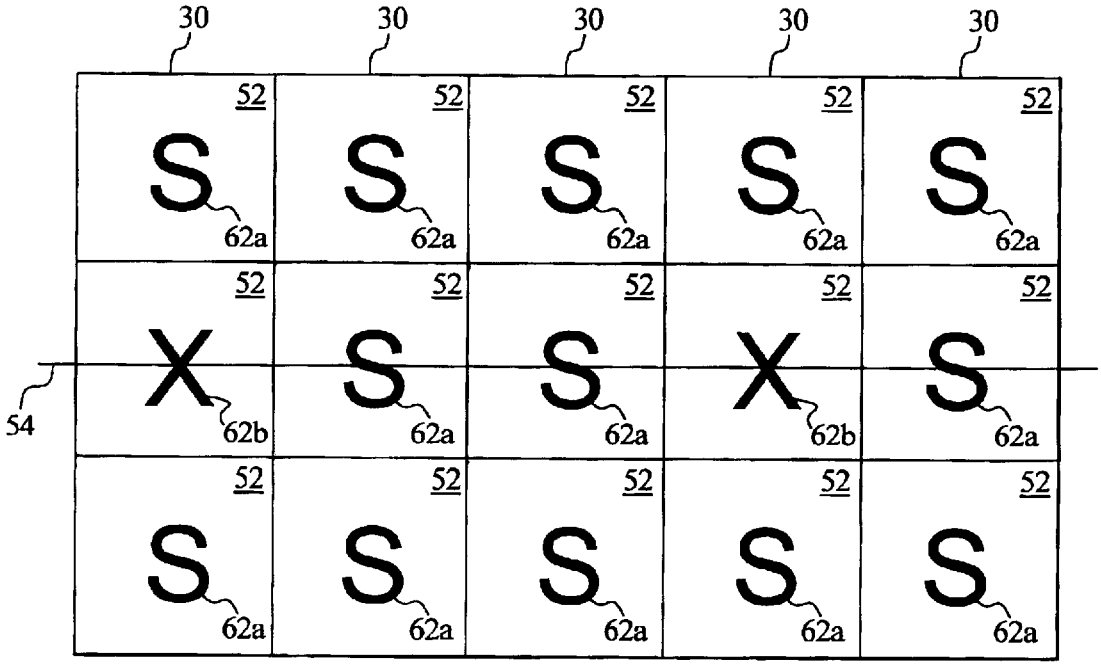
FIG. 7 is a top plan view of the reels, symbols and terminating condition in one embodiment of the present invention.

With reference to block 60 in FIG. 5, in operation the bonus round initiates when a bonus triggering event occurs. Once the bonus round initiates, the gaming device generates symbols 62 (shown in FIGS. 6 through 11) preferably by enabling the player to activate the symbol generator, as indicated by block 64 in FIG. 5. Preferably, the player can do so by pushing a play button 20 or another type of activator device.

Next, the gaming device displays the generated symbols 62, as indicated by block 66 in FIG. 5. Depending upon which symbols 62 the gaming device generates and where the gaming device displays them, a terminating condition may or may not occur. As indicated by blocks 70 and 72 in FIG. 5, if the terminating condition does occur, then the bonus round terminates and the gaming device provides the player with any payout due to the player. However, if a terminating condition does not occur, as indicated by diamond 68 in FIG. 5, the gaming device will then generate symbols 62 again, preferably by enabling the player to push play button 20 again. Furthermore, depending upon the particular design of the bonus scheme and the particular symbols 62 generated, the gaming device may also award the player with a bonus value prior to enabling the player to push play button 20 again. In such case, the gaming device preferably increases the value in a bonus value indicator (not shown).

As discussed earlier, in one preferred embodiment the symbol generator is a plurality of reels 30. The reels 30 display a plurality of symbols 62 at symbol areas 52, as shown in FIGS. 6 through 10. For example purposes only, in FIGS. 6 through 9 the result line 54 is located at the same location, horizontally extending through the middle row of the reels 30.

In this embodiment, illustrated in FIGS. 6 through 9, a variety of predetermined symbols 62 and predetermined combinations of symbols 62 can be used to define the terminating conditions. FIGS. 6 through 9 illustrate example partial or complete terminating conditions. It should be appreciated, however, that the present invention can include additional types of terminating conditions not illustrated here. In the example shown in FIG. 6, the symbol generator generated all of the symbols 62 shown. The symbols 62*a* which are of no particular type are indicated with the letter S and a particular symbol 62*b* (the letter X) is so indicated. In this example, the terminating condition is the letter X being displayed at any two symbol areas 52 located along the predetermined result line 54. Therefore, when the player reached X at only one symbol area 52 shown in FIG. 6, the bonus did not terminate because only one terminating symbol was displayed. When this same terminating condition is applied in another example shown in FIG. 7, the bonus round terminates because here the player generated the identical symbol 62*b* at two symbol areas 52 along result line 54.

Figure 8:
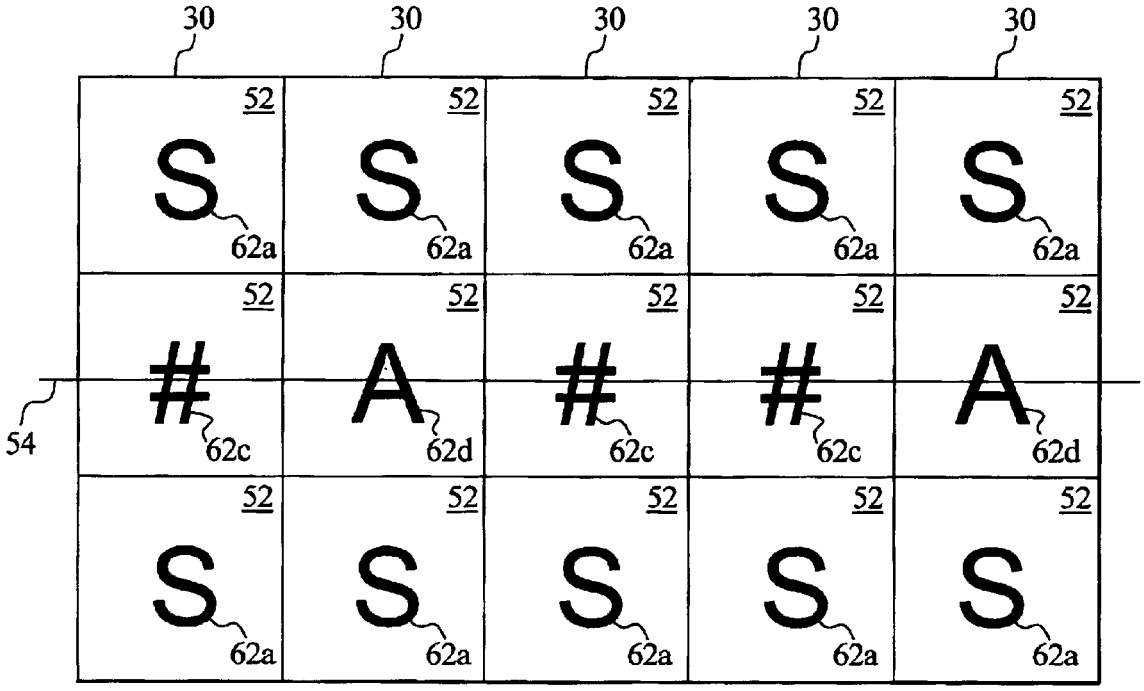
FIG. 8 is a top plan view of the reels, symbols and another terminating condition in one embodiment of the present invention.
Figure 9:
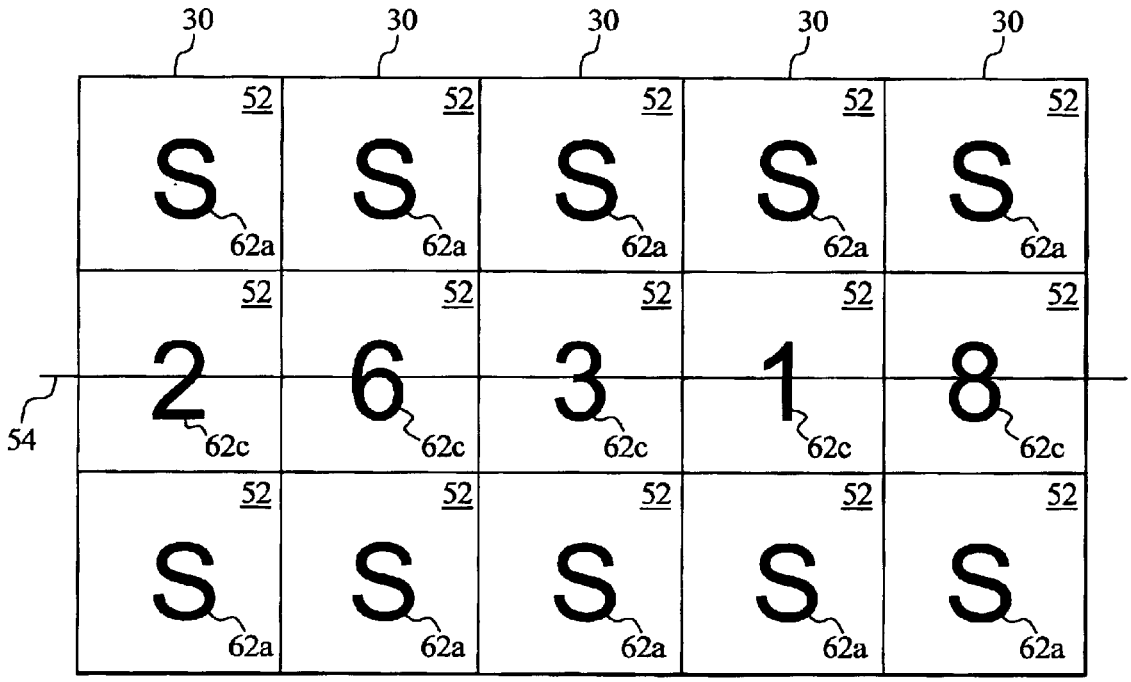
FIG. 9 is a top plan view of the reels, symbols and bonus values in one embodiment of the present invention.

In an alternative embodiment shown in FIG. 8, the symbols 62 are either numeric symbols 62*c* or non-numeric symbols 62*d*. Here, the terminating condition is the display of two or more non-numeric symbols 62*d* at symbol areas 52 located along the result line 54. As shown in FIG. 8, after pushing play button 20, the player generated several symbols 62*a* of various types at a variety of symbol areas 52. The player also generated four numeric symbols 62*c* and one non-numeric symbol 62*d*, all of which are located along result line 54. The numeric symbols 62*c* are represented in FIG. 8 by number signs, and the non-numeric symbol 62*d* is represented by the letter A. The display of the letter A at two symbol areas 52 on the result area terminates the bonus round because it fulfills the terminating condition. Preferably in this alternative embodiment, if the player avoids the terminating condition, the gaming device awards the player with an award value equal to the sum of all numeric symbols 62*d* displayed along the result line 54. In the example shown in FIG. 9, the player generated various types of symbols 62*a* at various symbol areas 52. Here, all of the symbols generated along result line 54 are numeric symbols 62*c*. Consequently, the gaming device awards the player with a bonus value of twenty (the sum of 2+6+3+1+8).

Figure 10:
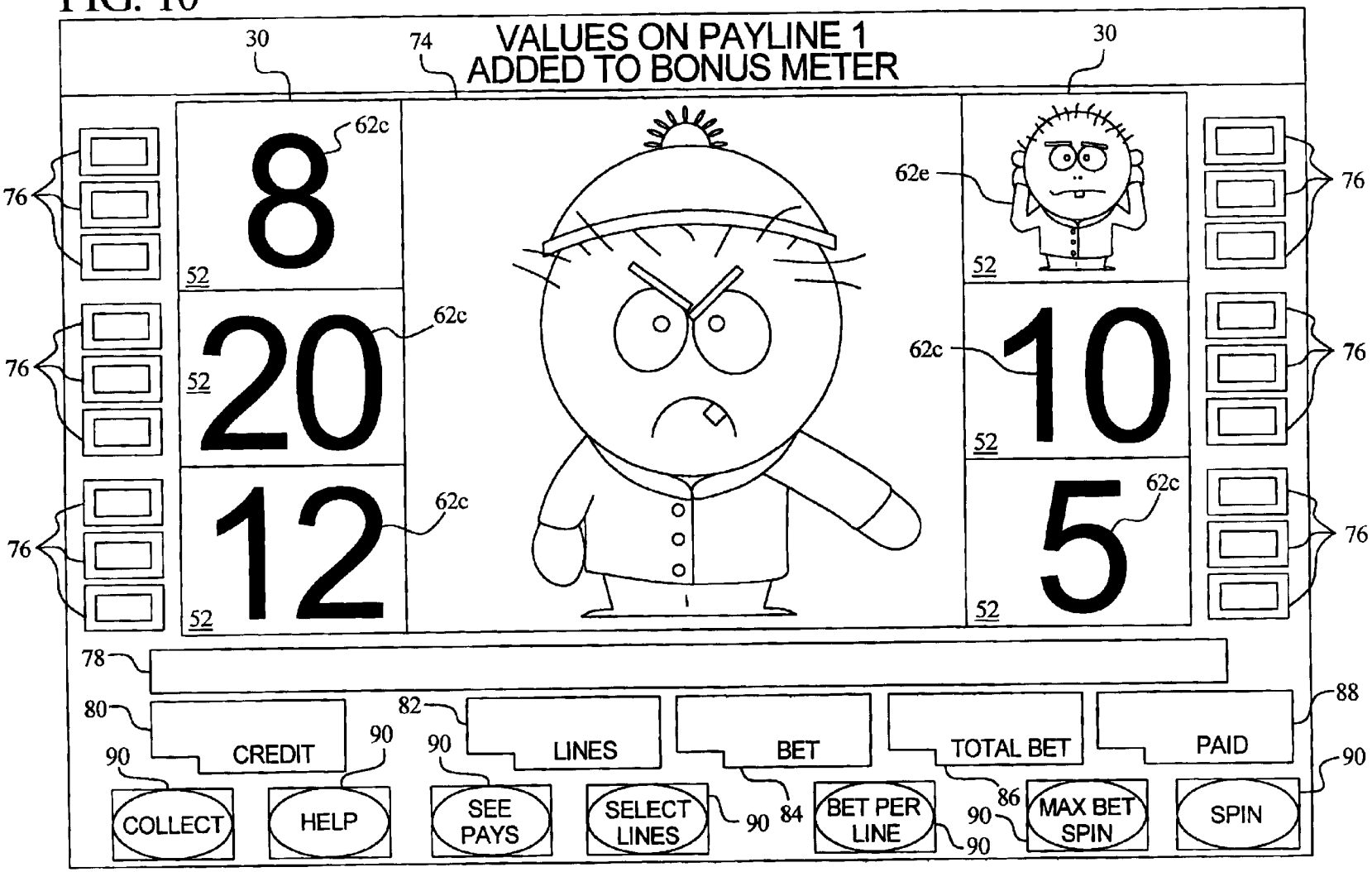
FIG. 10 is a top plan view of the reels, symbols and background screen in one embodiment of the present invention.

This alternative embodiment is further shown in the context of cartoon character symbols 62*e* and numeric symbols 62*c*, as shown in FIG. 10. Here, the symbols 62 are generated and displayed on two outer reels 30. The result area is the two symbol areas 52 located at the center of each reel 30. In this example bonus round, the gaming device generated numeric symbols 62*c* having the values, twenty and ten. Therefore, the gaming device awards the player with a value of thirty. The gaming device then enables the player to generate additional symbols 62 until a character symbol 62*e* is displayed at the result area, at which time the bonus round terminates.

Preferably this embodiment includes a background screen 74 for viewing purposes, as shown in FIG. 10. However, this background screen 74 can also be used to inform the player about the nature of the terminating condition for the bonus round. For example, a terminating condition could be a symbol 62 displayed at any result area and which is identical to (or is different from) the graphics of background screen 74.

As is apparent by viewing FIG. 10, this alternative embodiment preferably incorporates the South Park cartoon theme. SOUTH PARK™ is a trademark and service mark of Comedy Partners, New York, N.Y., and is used with permission from Comedy Partners by the assignee of the present invention. In addition, this preferred embodiment can include audio features (i.e., songs, voices, and other sound effects) which are consistent with the cartoon theme of this preferred embodiment.

Furthermore, preferably this preferred embodiment includes a line message 76 shown in FIG. 10. Line message 76 indicates, preferably in numeric form, the number of credits the player decided to bet for each line. Furthermore, preferably this preferred embodiment includes a plurality of windows for providing information to the player. As shown in FIG. 10, such windows include: (a) a bonus spin window (now shown) which displays the number of remaining bonus spins; (b) a credit window 78 which displays the number of credits which the gaming device provides to a player after each spin; (c) a credit balance window 80 which displays the player's current credit balance; (d) a line selection window 82 which displays the number of lines upon which the player is betting; (e) a bet window 84 which displays the number of credits the player is betting per line; (f) a total bet window 86 which displays the total credits which the player is betting; and (g) a pay window 88 which displays the total of credits which the gaming device has paid to the player on the previous game. Preferably, this preferred embodiment also includes a plurality of buttons 90 which the player uses to select game options and play the game, including a cash out button, help button, pay table button, select lines button, bet per line button, max bet button and stop spin button.

Figure 11:
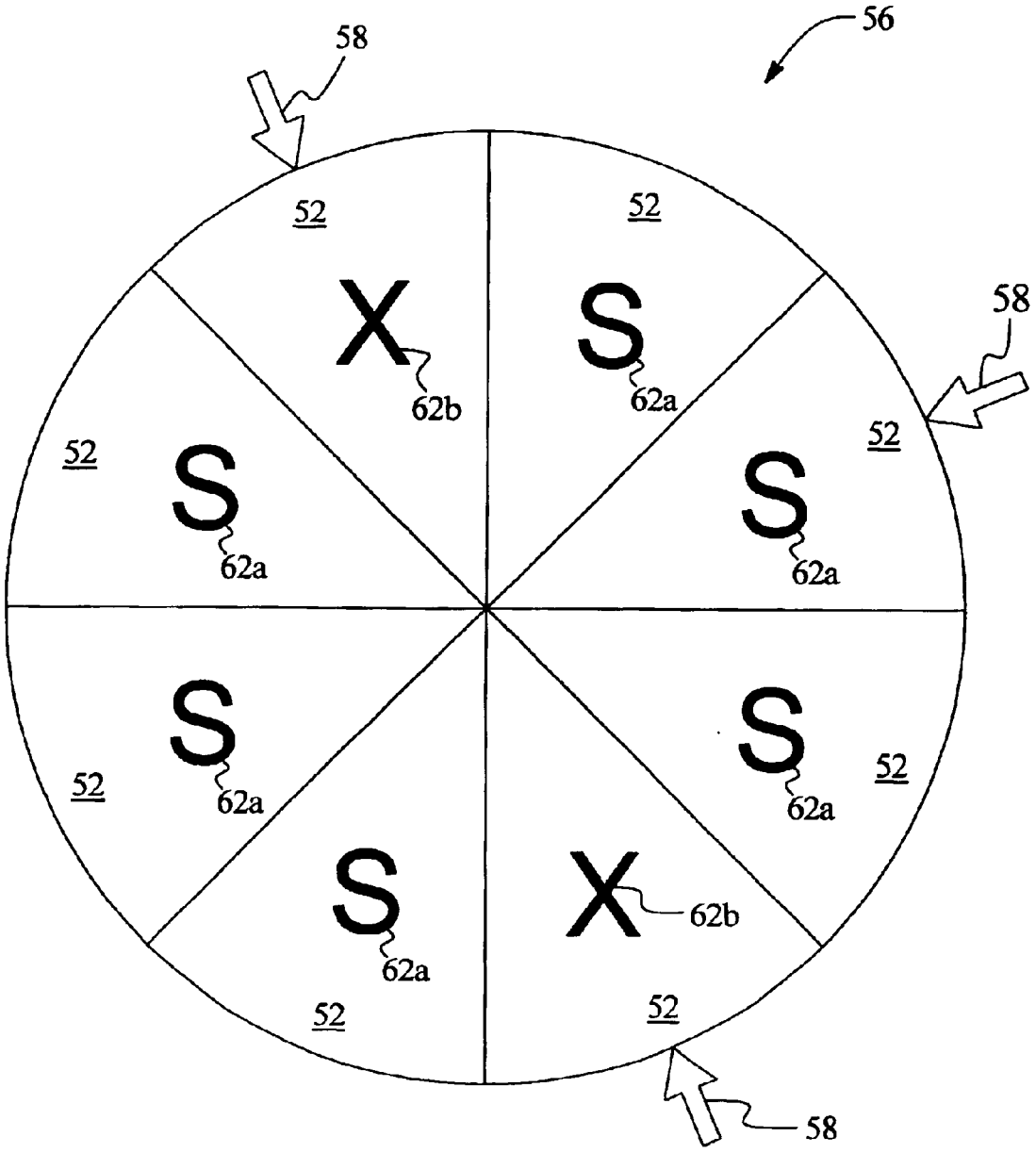
FIG. 11 is a top plan view of the spinning wheel, symbols and terminating condition in one embodiment of the present invention.

In the spinning wheel embodiment described earlier, preferably each symbol area 52 includes a symbol 62, as shown in FIG. 11. Depending upon the type of the terminating condition and the symbols 62 displayed at the result pointers 58, the bonus round may or may not terminate. Preferably, when the player pushes play button 20, the spinning wheel 56 rotates clockwise and/or counterclockwise and eventually comes to a stop. One or more result pointers 58 identifies certain symbols 62. The terminating condition occurs when the spinning wheel 56 stops spinning such that two or more predetermined symbols 62 or combinations of symbols 62 are aligned with the result pointers 58. Once this occurs, the bonus round terminates. In the example shown in FIG. 11, the terminating condition occurs when at least two result pointers point at two symbols 62*b*, the identical letters X. Here, the spinning wheel 56 stopped such that the result pointers 58 pointed at one symbol 62*a*, and two symbols 62*b*. Therefore, the bonus round terminates.

Figure 12:
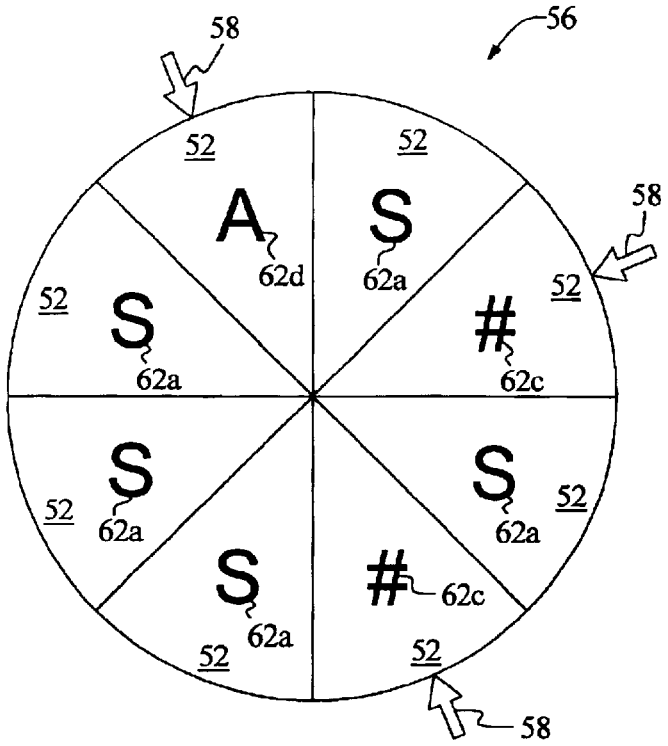
FIG. 12 is a top plan view of two spinning wheels, symbols and terminating condition in one embodiment of the present invention.
Figure 12:
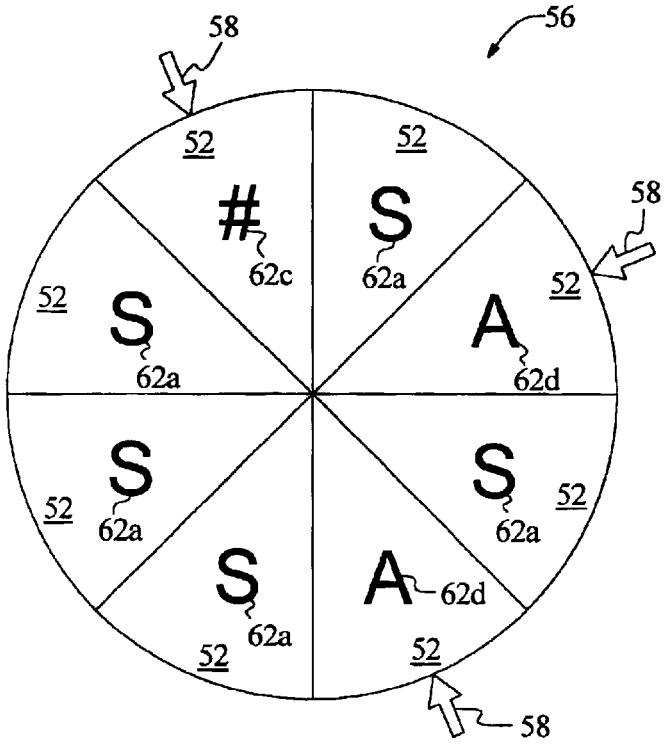

In an alternative spinning wheel embodiment shown in FIG. 12, the gaming device displays two spinning wheels 56. The symbols 62 displayed on the spinning wheels 56 are either numeric symbols 62*c* or non-numeric symbols 62*d*. Here, the terminating condition is the display of one or more non-numeric symbols 62*d* at each spinning wheel 56 at the symbol areas 52 located at the result pointers 58.

As shown in FIG. 12, after pushing play button 20, the player generated several symbols 62*a* of various types at a variety of symbol areas 52 at each spinning wheel 56. The player also generated one non-numeric symbol 62*d* at the upper spinning wheel 56 and two non-numeric symbols 62*d* at the lower spinning wheel 56, all being displayed at result pointers 58. The numeric symbols 62*c* are represented in FIG. 12 by number signs, and the non-numeric symbols 62*d* are represented by the letter A. In this example, the display of the letter A at one result pointer 58 of the upper spinning wheel 56, and the display of the letter A at two of the result pointers 58 terminates the bonus round because it fulfills the terminating condition. Preferably, in this embodiment if the player avoids the terminating condition, the gaming device awards the player with an award value equal to the sum of all numeric symbols 62*c* displayed at the result pointers 58 of both spinning wheels 56.

The bonus scheme of the gaming device of the present invention involves one or more symbol generators and one or more predetermined conditions which terminate the bonus round when certain symbols are generated and displayed. In one preferred embodiment, the symbol generator is a plurality of reels which display a plurality of symbols. In another preferred embodiment, the symbol generator is a spinning wheel which includes a plurality of symbols. In both preferred embodiments, the terminating condition includes two or more predetermined symbols or combinations of predetermined symbols which, when displayed at predetermined areas, effectively terminate the bonus round. This type of bonus scheme provides gaming devices with the capacity to terminate bonus rounds while providing players with excitement and enjoyment.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a game operable upon a wager by a player;

a single symbol generator operable upon an event associated with the game, said single symbol generator including a plurality of symbols;

at least one terminating condition, said terminating condition including a plurality of predetermined symbols of said symbols, wherein the symbol generator is operable to simultaneously generate a plurality of said symbols, wherein the simultaneous generation of the symbols by the symbol generator terminates when the terminating condition occurs including the simultaneous generation by the symbol generator of at least two of the predetermined symbols in a designated result area associated with said symbol generator, and wherein the simultaneous generation of less than said at least two predetermined symbols (a) does not cause termination of the simultaneous generations of the symbols by the symbol generator, (b) does not cause part of the terminating condition to be satisfied, and (c) does not cause an accumulation of any of the predetermined symbols for subsequently achieving the terminating condition; and at least one outcome associated with the simultaneous generation of at least two of the symbols and adapted to be provided to the player.

2. The gaming device of claim 1, wherein the terminating condition includes at least two related predetermined symbols.

3. The gaming device of claim 1, wherein the predetermined symbols are different.

4. The gaming device of claim 1, wherein the outcome includes an award provided to the player for each simultaneous generation by the symbol generator of symbols which does not cause the predetermined condition to occur.

5. The gaming device of claim 1, wherein the symbol generator includes a single wheel.

6. The gaming device of claim 5, wherein the designated result area includes at least two symbol areas of the single symbol generator which are indicated by result pointers associated with the wheel.

7. The gaming device of claim 6, wherein the wheel moves relative to the result pointers.

8. The gaming device of claim 6, wherein the result pointers move relative to the wheel.

9. The gaming device of claim 1, wherein the generated symbols are numeric and non-numeric symbols.

10. The gaming device of claim 9, wherein the predetermined symbols are non-numeric symbols.

11. The gaming device of claim 10, wherein the outcome includes an award value equal to the sum of the numeric generated symbols.

12. The gaming device of claim 1, which includes a display device operable to display the single symbol generator.

13. The gaming device of claim 12, wherein the symbol generator simultaneously generates more than two symbols in each generation.

14. A method of operating a game of a gaming device, said method comprising:

(a) initiating the game including a plurality of symbols, said symbols including a plurality of predetermine symbols;

(b) simultaneously generating a plurality of the symbols;

(c) displaying the generated symbols;

(d) repeating steps (b) and (c) until at least two of said predetermined symbols are simultaneously generated by the symbol generator in a designated result area associated with said symbol generator, and wherein the simultaneous generation of less than said at least two predetermined symbols (i) does not cause termination of the game, (ii) does not cause part of a terminating condition including the predetermined symbols to be satisfied, and (iii) does not cause an accumulation of any of the predetermined symbols for subsequent simultaneous generations of the predetermined symbols; and (e) terminating the game.

15. The method of claim 14, which includes providing an award to a player for each simultaneous generation by the symbol generator of symbols which does not include simultaneous generation of the predetermined symbols.

16. The method of claim 15, wherein step (b) includes generating the symbols on a single wheel and wherein the designated result area includes at least two symbol areas of the single wheel which are indicated by result pointers associated with the wheel.

17. The method of claim 16, which includes the step of moving the wheel relative to the result pointers.

18. The method of claim 16, which includes the step of moving the result pointers relative to the wheel.

19. The method of claim 14, wherein the step of generating symbols includes the step of generating numeric and non-numeric symbols.

20. The method of claim 19, wherein the predetermined symbols are non-numeric symbols.

21. The method of claim 19, which includes the step of providing a player with an award value equal to the sum of the numeric symbols generated by the symbol generator each time the predetermined symbols are not simultaneously generated by the symbol generator in the designated result area associated with said symbol generator.

22. The method of claim 14, which includes the step of displaying the single symbol generator on a display device.

23. The method of claim 14, wherein the game is provided to a player through a data network.

24. The method of claim 23, wherein the data network is an internet.

25. A gaming device comprising:

a game operable upon a wager by a player;

a secondary game operable upon an event associated with the game;

a single wheel in the secondary game including a plurality of sections, each of said sections including at least one symbol;

at least one terminating condition, said terminating condition including a plurality of predetermined symbols of said symbols;

at least two section indicators associated with said wheel;

a processor operable to activate the single wheel, cause the section indicators to indicate sections on the wheel and terminate said secondary game if the terminating condition occurs including the simultaneous indication by the section indicators of sections on the wheel including at least two of the predetermined symbols, and wherein the simultaneous indication of less than said at least two predetermined symbols by the section indicators (a) does not cause termination of the secondary game, (b) does not cause part of the terminating condition to be satisfied, and (c) does not cause an accumulation of any of the predetermined symbols for subsequently achieving the terminating condition; and at least one outcome associated with the simultaneous indication of at least two of the symbols and adapted to be provided to the player.

26. The gaming device of claim 25, wherein the terminating condition includes at least two related predetermined symbols.

27. The gaming device of claim 25, wherein the predetermined symbols are different.

28. The gaming device of claim 25, which includes an award provided to a player for each activation of the wheel which does not cause the predetermined condition to occur.

29. The gaming device of claim 25, wherein the wheel moves relative to the section indicators.

30. The gaming device of claim 25, wherein the section indicators move relative to the wheel.

31. The gaming device of claim 25, wherein the symbols include numeric and non-numeric symbols.

32. The gaming device of claim 31, wherein the predetermined symbols are non-numeric symbols.

33. The gaming device of claim 31, which includes an award value equal to the sum of the numeric symbols associated with sections indicated by the section indicators.

34. A method of operating a game of a gaming device, said method comprising:

(a) initiating a game including a plurality of symbols, said symbols including a plurality of predetermined symbols;

(b) activating a wheel including a plurality of sections, said sections including said symbols;

(c) indicating sections on the wheel with at least two section indicators;

(d) providing any award to a player associated with said symbols of the indicated sections; and (e) repeating steps (b) to (d) until at least two sections including the predetermined symbols are simultaneously indicated by the section indicators, wherein the simultaneous indication of less than said at least two sections including predetermined symbols by the section indicators (i) does not cause termination of the game, (ii) does not cause part of a terminating condition including the predetermined symbols to be satisfied, and (iii) does not cause an accumulation of any of the predetermined symbols for subsequent simultaneous indication of the predetermined symbols.

35. The method of claim 34, which includes providing an award to a player for each simultaneous indication by the section indicators of sections including symbols which does not include the simultaneous indication of at least two sections including the predetermined symbols.

36. The method of claim 34, which includes the step of moving the wheel relative to the section indicators.

37. The method of claim 34, which includes the step of moving the section indicators relative to the wheel.

38. The method of claim 34, wherein the symbols include numeric and non-numeric symbols.

39. The method of claim 38, wherein the predetermined symbols are non-numeric symbols.

40. The method of claim 38, which includes the step of providing a player with an award value equal to the sum of any numeric symbols associated with sections indicated by the section indicator, when at least two sections including the predetermined symbols are not simultaneously indicated by the section indicators.

41. The method of claim 34, wherein the game is provided to a player through a data network.

42. The method of claim 41, wherein the data network is an internet.

43. A gaming device comprising:

a game;

a plurality of independent symbol generators in said game, each including a plurality of symbols;

at least one terminating condition, said terminating condition including at least two predetermined symbols, wherein one of the symbol generators is adapted to generate one of said predetermined symbols and another of said symbol generators is adapted to generate another one of said predetermined symbols;

a plurality of simultaneously generated symbols, including one symbol from each symbol generator; and a display device for displaying the generated symbols, whereby the game terminates when the terminating condition occurs including the simultaneous generation by the symbol generators of each of the predetermined symbols in a designated result area associated with said symbol generators, and wherein the simultaneous generation of less than said at least two predetermined symbols (a) does not cause termination of the game, (b) does not cause part of the terminating condition to be satisfied, and (c) does not cause an accumulation of any of the predetermined symbols for subsequently achieving the terminating condition.

44. The gaming device of claim 43, wherein the terminating condition is the display of at least two related predetermined symbols.

45. The gaming device of claim 43, wherein the terminating condition includes the display of more than two predetermined symbols.

46. The gaming device of claim 43, which includes an award provided to a player for each simultaneous generation by the symbol generators of symbols which does not cause the predetermined condition to occur.

47. The gaming device of claim 43, wherein each of the symbol generators are reels.

48. The gaming device of claim 47, wherein the result areas are along the reels.

49. The gaming device of claim 43, wherein the symbol generators are a plurality of reels, the symbols include numeric and non-numeric symbols and the non-numeric symbols are the predetermined symbols.

50. The gaming device of claim 43, wherein the symbol generators include at least one spinning wheel.

51. The gaming device of claim 43, wherein the generated symbols are numeric and non-numeric symbols.

52. The gaming device of claim 51, wherein the predetermined symbols are non-numeric symbols.

53. The gaming device of claim 52, which includes an award value equal to the sum of the numeric generated symbols.

54. A method of operating a game of a gaming device, said method comprising:

(a) initiating the game;

(b) generating a plurality of symbols on a plurality of symbol generators, said symbols including a plurality of predetermined symbols wherein one of the symbol generators is adapted to generate one of the predetermined symbols and another of said symbol generators is adapted to generate another of the predetermined symbols;

(c) displaying the generated symbols;

(d) repeating steps (b) and (c) until at least two of the predetermined symbols are simultaneously generated by the symbol generators in a designated result area associated with each said symbol generators, and wherein the simultaneous generation of less than said at least two predetermined symbols (i) does not cause termination of the game and (ii) does not cause an accumulation of any of the predetermined symbols for subsequent simultaneous generation of the predetermined symbols; and (e) terminating the game.

55. The method of claim 54, which includes providing an award to a player for each simultaneous generation by the symbol generators of symbols which does not include simultaneous generation of at least two of the predetermined symbols.

56. The method of claim 55, wherein step (b) includes generating the symbols on reels and the result areas are along a payline associated with the reels.

57. The method of claim 54, wherein the step of generating symbols includes the step of generating numeric and non-numeric symbols.

58. The method of claim 57, which includes the step of providing at least two non-numeric symbols as the predetermined symbols.

59. The method of claim 57, which includes the step of providing a player with an award value equal to the sum of the numeric symbols generated by the symbol generators each time the at least two predetermined symbols are not simultaneously generated by the symbol generators in the designated result area associated with each said symbol generators.

60. The method of claim 54, wherein the step of generating symbols includes the step of providing a plurality of reels and a plurality of symbols on the reels.

61. The method of claim 54, wherein the step of generating symbols includes the step of providing at least one spinning wheel and a plurality of symbols on the spinning wheel.

62. The method of claim 54, wherein the game is provided to a player through a data network.

63. The method of claim 62, wherein the data network is an internet.

64. A gaming device comprising:

a game;

a plurality of independent symbol generators in said game, each symbol generator including a plurality of symbols;

at least one terminating condition, said terminating condition including at least two predetermined symbols, wherein a first predetermined symbol is adapted to be generated by first one of the symbol generators and a second predetermined symbol is adapted to be generated by a second one of said symbol generators;

a display device; and a processor operable with said display device and symbol generators to cause the random generation of a plurality of said symbols including one symbol from each symbol generator and terminate said game if the terminating condition occurs including the simultaneous generation by the symbol generators of each of the first and second predetermined symbols in a designated result area associated with said first and second symbol generators, and wherein the simultaneous generation of less than said at least two predetermined symbols (a) does not cause termination of the game, (b) does not cause part of the terminating condition to be satisfied, and (c) does not cause an accumulation of any of the predetermined symbols for subsequently achieving the terminating condition.

65. The gaming device of claim 64, wherein said terminating condition includes at least two related predetermined symbols.

66. The gaming device of claim 64, wherein said terminating condition includes at least two different predetermined symbols.

67. The gaming device of claim 64, wherein the symbol generators include a plurality of reels.

68. The gaming device of claim 64, wherein the symbol generators include at least one spinning wheel.

69. The gaming device of claim 64, wherein the symbols are numeric and non-numeric symbols.

70. The gaming device of claim 69, wherein the predetermined symbols are non-numeric symbols.

71. The gaming device of claim 69, which includes an award provided to the player based on the generated numeric symbols when the predetermined condition does not occur.

72. A method of operating a gaming device comprising the steps of:

(a) initiating a game;

(b) randomly generating a plurality of symbols on a plurality of symbol generators, wherein a first symbol generator is adapted to generate a first predetermined symbol and a second symbol generator is adapted to generate a second predetermined symbol;

(c) displaying the generated symbols;

(d) providing an award, if any, to a player based on said symbols; and (e) repeating steps (b) to (d) until the first and second predetermined symbols are simultaneously generated by the first and second symbol generators in a designated result area associated with each of said symbol generators, and wherein the simultaneous generation of less than said first and second predetermined symbols (i) does not cause termination of the game and (ii) does not cause an accumulation of any of the predetermined symbols for subsequent simultaneous generation of the predetermined symbols.

73. The method of claim 72, wherein the step of randomly generating a plurality of symbols includes the step of generating numeric and non-numeric symbols.

74. The method of claim 73, at least two non-numeric symbols are the first and second predetermined symbols.

75. The method of claim 72, wherein the game is provided to a player through a data network.

76. The method of claim 75, wherein the data network is an internet.

* * * * *